US006484796B2

(12) United States Patent
Demuth et al.

(10) Patent No.: US 6,484,796 B2
(45) Date of Patent: Nov. 26, 2002

(54) HEAT-EXCHANGER TUBE BLOCK WITH A PLURALITY OF SLOTTED HEADER TUBES

(75) Inventors: Walter Demuth, Gerlingen (DE); Martin Kotsch, Ludwigsburg (DE); Hans-Joachim Krauss, Stuttgart (DE); Hagen Mittelstrass, Bondorf (DE); Harald Raiser, Ballingen (DE); Jochen Schumm, Eberdingen (DE); Michael Sickelmann, Stuttgart (DE); Karl-Heinz Staffa, Stuttgart (DE); Christoph Walter, Stuttgart (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 10/060,085

(22) Filed: Jan. 31, 2002

(65) Prior Publication Data

US 2002/0112849 A1 Aug. 22, 2002

(30) Foreign Application Priority Data

Jan. 31, 2001 (DE) ..... 101 05 202

(51) Int. Cl.[7] ..... F28F 9/02

(52) U.S. Cl. ..... 165/144; 165/150; 165/153; 165/176; 285/125.1

(58) Field of Search ..... 165/144, 150, 165/153, 173, 175, 176, 178; 285/125.1, 133.11, 133.6, 189, 179, 399, 400

(56) References Cited

U.S. PATENT DOCUMENTS

| | | | | | |
|---|---|---|---|---|---|
| 4,386,652 | A | * | 6/1983 | Dragojevic | 165/144 |
| 4,620,590 | A | * | 11/1986 | Koisuka et al. | 165/150 |
| 4,678,112 | A | * | 7/1987 | Koisuka et al. | 165/173 |
| D304,855 | S | * | 11/1989 | Aoki | D23/323 |
| 5,036,909 | A | * | 8/1991 | Whitehead et al. | 165/133 |
| 5,682,944 | A | * | 11/1997 | Yamamoto et al. | 165/110 |
| 5,749,412 | A | | 5/1998 | Balthazard | 165/67 |
| 5,868,198 | A | | 2/1999 | Kato | 165/153 |
| 6,170,569 | B1 | | 1/2001 | Dienhart et al. | 165/173 |
| 6,176,303 | B1 | | 1/2001 | Kobayashi et al. | 165/175 |

FOREIGN PATENT DOCUMENTS

| | | | | |
|---|---|---|---|---|
| DE | 34 43 305 | | 6/1990 | |
| DE | 198 00 943 | | 8/1998 | |
| DE | 197 29 497 | | 1/1999 | |
| DE | 199 06 063 | | 8/1999 | |
| DE | 198 46 267 | | 4/2000 | |
| DE | 199 11 334 | | 9/2000 | |
| EP | 0 334 683 | | 9/1989 | |
| EP | 0 805 329 | | 11/1997 | |
| JP | 4-187991 | A * | 7/1992 | F28D/1/053 |
| JP | 5-187786 | A * | 7/1993 | F28D/1/053 |
| WO | 96/01973 | | 1/1996 | |

* cited by examiner

*Primary Examiner*—Allen Flanigan
(74) *Attorney, Agent, or Firm*—Foley & Lardner

(57) ABSTRACT

A heat-exchanger tube block is disclosed having at least two header tubes (6, 7), which are C-shaped in cross section and each of which has a continuous longitudinal slot (10, 11). Flat tubes (2*a*, 2*b*) are inserted into the header-tube longitudinal slots. A cover-plate element (12) is provided which has a plurality of C-shaped openings and is fitted over one end of the at least two header tubes, so that the header tubes respectively fit into one of the openings and are secured in a fluid-tight manner. The tube-block can be used, for example, in an evaporator of $CO_2$ air-conditioning installations for a motor vehicle.

12 Claims, 2 Drawing Sheets

HEAT-EXCHANGER TUBE BLOCK WITH A PLURALITY OF SLOTTED HEADER TUBES

CROSS-REFERENCE TO RELATED PATENT APPLICATIONS

The right of priority under 35 U.S.C. §119(a) is claimed based on German Patent Application No. 101 05 202.2, filed Jan. 31, 2001, the entire disclosure of which is hereby incorporated by reference.

BACKGROUND OF THE INVENTION

The present invention relates to a heat-exchanger tube block comprising at least two header tubes, each having a C-shaped cross section and having a continuous longitudinal slot, and flat tubes inserted into the header-tube longitudinal slots. Tube blocks of this type are employed, for example, in heat exchangers for motor vehicle air-conditioning installations.

DE 198 462 67 A1 describes such a heat-exchanger tube block, which includes a stack of straight flat tubes whose ends are inserted into one longitudinal slot on each of two header tubes. The header tubes are arranged in parallel along two mutually opposite block sides. The header tubes can be manufactured from respective tube blanks, in which the continuous longitudinal slot is inserted by milling or the like or is manufactured by bending a respective sheet-metal strip around into the desired C cross-sectional shape. A cup-shaped sleeve is fitted over the appropriate end of the header tube, as an end cover. On the one hand, the bottom of this cup-shaped sleeve axially covers the header tube and on the other hand, by means of a corresponding side wall region, it radially covers a part of the longitudinal slot which is possibly still free and is not completely filled by the inserted flat-tube ends.

In certain applications, a plurality of header tubes are arranged close to one another. As an example, DE 197 29 497 A1 discloses an evaporator tube block having serpentine-shaped flat tubes whose ends are fitted into a common connecting tube. The connecting tube includes two parallel, abutting header tubes as integrated constituent parts. In the usual manner, one of these header tubes functions as the actual collector-tube (outlet) duct and the other as the distributor-tube (inlet) duct.

SUMMARY OF THE INVENTION

One principal object of the present invention is to provide a novel heat-exchanger tube block that can be manufactured with relatively little expense and/or complexity and yet possesses the necessary fluid-tightness and pressure resistance, so that it can be used, e.g., in a $CO_2$-based automotive air-conditioning system.

A further object of the invention is to provide an automotive air-conditioning system embodying the improved heat exchanger tube block according to the invention.

In accordance with one aspect of the present invention, there has been provided a heat-exchanger tube block, comprising: at least two header tubes, each of which has a C-shaped cross section defining an inner flow cross-section and a continuous longitudinal slot therein; at least two flat tubes inserted into the header-tube longitudinal slots; and a first cover-plate element having a plurality of C-shaped openings therein, the first cover-plate element being applied to a first end of the at least two header tubes, such that each header tube respectively fits into one of the openings and is secured therein in a fluid-tight manner.

In a preferred embodiment, the tube block further comprises a second cover-plate element applied to a second end of the at least two header tubes. The second cover-plate element has a plurality of openings for fitting over each respective header tube, such that the openings leave the inner header-tube flow cross section at least partially open.

In accordance with another aspect of the invention, there has been provided an automotive air-conditioning system comprising a heat exchanger having a tube block, wherein the tube block comprises the improved tube block described above.

Further objects, features and advantages of the present invention will become apparent from the detailed description of preferred embodiments that follows, when considered together with the accompanying figures of drawing.

BRIEF DESCRIPTION OF THE DRAWINGS In the drawings.

DETAILED DESCRIPTION OF THE PREFERRED EMBODIMENTS

Figure 1:
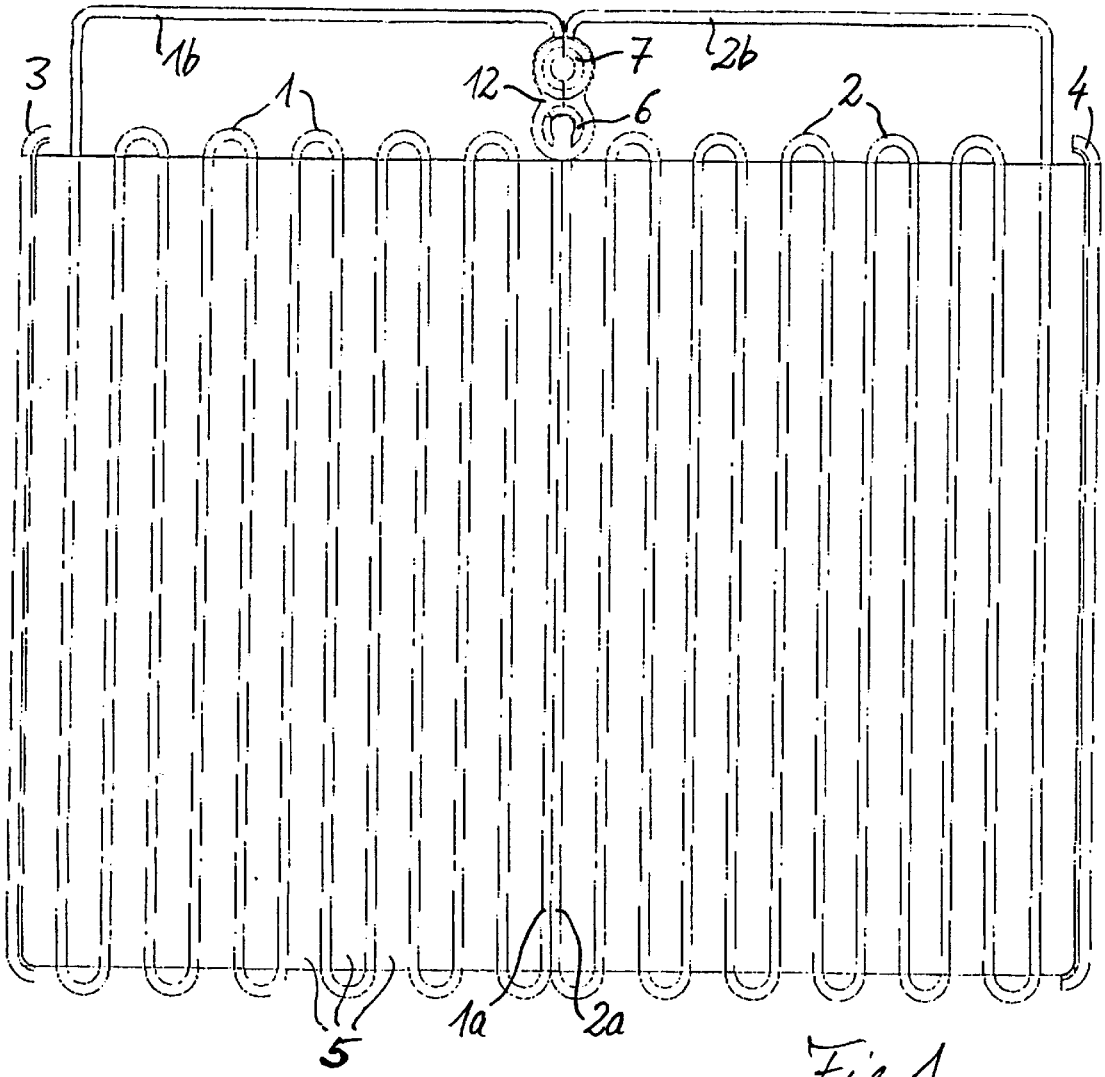
FIG. 1 is a schematic plan view of an evaporator tube block of serpentine flat-tube construction having two adjacent header tubes.

The invention provides a heat-exchanger tube block that includes a cover-plate element, which has a plurality of C-shaped openings and is fitted over one end of the at least two header tubes, so that each of the header tubes respectively fits into one of the openings and is secured in a fluid-tight manner. The C-contour of the openings matches the C-shaped header-tube cross section and permits the fluid-tight fitting of the header tubes into the openings without difficulty. The cover-plate element is fitted over the header tubes and, in the process, the respective header tube penetrates through the associated opening. After fitting the cover on, the residual gap between the header tube and the edge of the opening is closed in a fluid-tight manner, for example, by means of brazing.

Because the header tubes have a continuous longitudinal slot, they can optionally be manufactured from a flat blank, exclusively by a bending process, without requiring any machining work on the tube.

According to a preferred embodiment, a heat-exchanger tube block includes a further cover-plate element that has a plurality of openings for fitting over the respective header tube(s). It is fitted over the other end of the at least two header tubes, and the openings are designed in such a way that they leave the inner flow cross section of the inserted header tubes at least partially free.

One illustrative and advantageous embodiment of the invention is represented in the drawings and is described below with reference to the drawings.

The tube/fin block represented in FIG. 1 can, for example, be used in an evaporator of a motor vehicle air-conditioning installation. It is possible to design it without difficulty so that it has the pressure resistance necessary for installations that operate with $CO_2$ refrigerant. The tube/fin block is of the serpentine flat-tube type and includes two serpentine-shaped multi-chamber flat tubes 1, 2, which are arranged in side-by-side relationship between two lateral cover plates 3, 4. Heat-conducting corrugated fins 5 are fixed in the usual manner between the individual serpentine windings of the flat tubes 1, 2.

The inner end sections 1*a*, 2*a* of the two serpentine flat tubes 1, 2 are contiguous and preferably abut one another with surface contact in the longitudinal central region of the block. At the upper block side in FIG. 1, the two abutting flat-tube end sections 1*a*, 2*a* open into a first header tube 6 of C-shaped cross section. The other, outer end sections 1*b*, 2*b* of the two serpentine flat tubes 1, 2 are led out on the upper block side, are brought inwardly together by a first right-angle bend and are led downwardly in the longitudinal central region of the block by a second bend and are joined into a second header tube 7 of C-shaped cross section. The second header tube 7 is arranged above the first header tube 6, parallel to it and at a small distance away.

Figure 2:
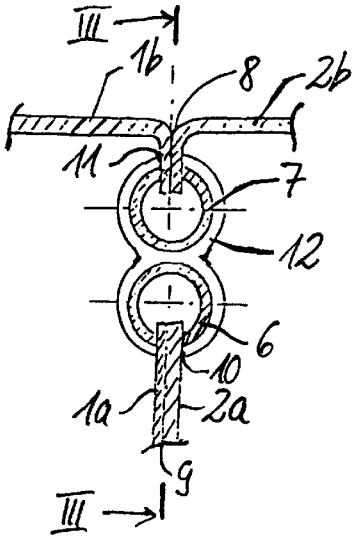
FIG. 2 is a detail cross-sectional view of a portion of FIG. 1, in the region of the header tubes.

As may be seen, particularly from FIG. 2, the two outer end sections 1*b*, 2*b* of the serpentine flat tubes 1, 2 are introduced from above preferably with surface contact, by means of their bent ends, into the upper header tube 7, in the same way as the two inner end sections 1*a*, 2*a* are introduced from below, preferably with mutual surface contact, into the lower header tube 6. For the purpose of braze sealing, brazing foil 8, 9 is respectively inserted between the mutually adjacent flat tube ends inserted into the header tubes 6, 7.

The header tubes 6, 7 each have a continuous longitudinal slot 10, 11 for accommodating the flat-tube ends. From the point of view of manufacturing technology, these longitudinal slots can be very simply realized, without machining operations, by manufacturing the two header tubes 6, 7 from flat metal strips using a rolling process. The flat metal strips are bent into the desired C cross-sectional shape, while leaving free the respective continuous longitudinal slots 10, 11. This provides an economy in operational procedures and, in addition, avoids the danger of chips (from cutting) reaching the inside of the header tubes, and possibly leading to blockage of the refrigerant circuit in later operation. Brazing alloy-clad material is preferably used for the header tubes 6, 7.

Figure 3:
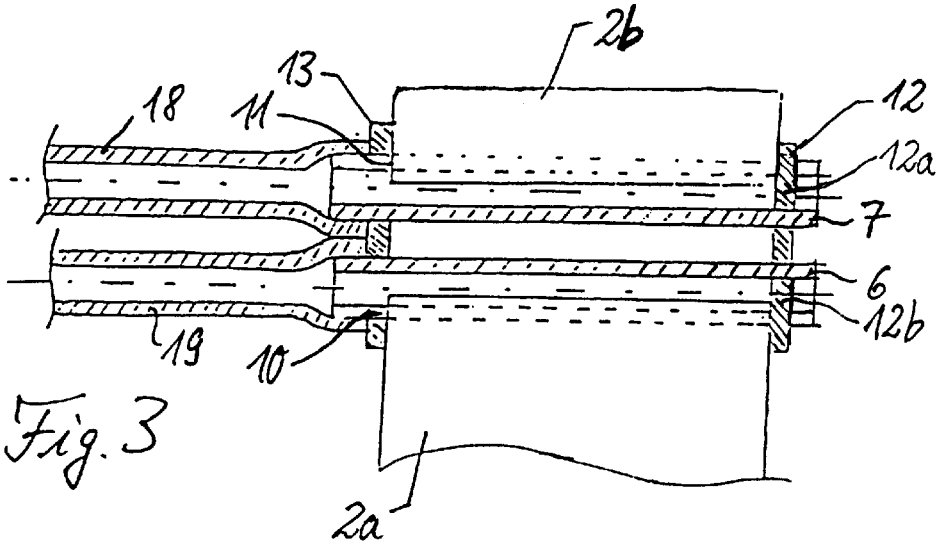
FIG. 3 is a cross-sectional view along the line III—III of FIG. 2.
Figure 4:
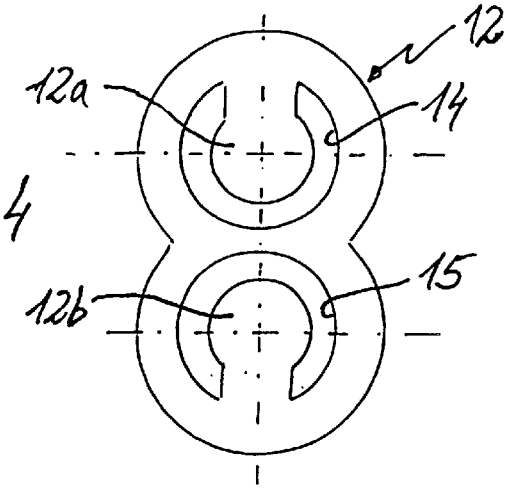
FIG. 4 is a plan view of a first cover-plate element used in the tube block of FIGS. 1 to 3.
Figure 5:
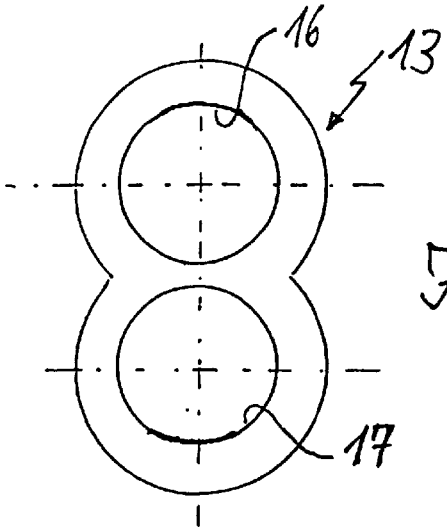
FIG. 5 is a plan view of a second cover-plate element used in the tube block of FIGS. 1 to 3.

As may be seen, particularly from the sectional representation of FIG. 3, one cover-plate element 12, 13 is provided on each end of the two header-tubes. These cover-plate elements 12, 13 are realized in the example shown as figure-8-shaped plates having apertures therein. FIGS. 4 and 5 show the two respective cover plates 12, 13 in individual representations. From these, it may be seen that the apertures are configured in different ways to satisfy different objectives.

One cover plate 12, shown in FIG. 4, is provided with two C-shaped insertion openings 14, 15, which correspond to the C-shaped cross-sectional contour of the header tubes 6, 7 and, in their reciprocal positions, correspond to the positions of the two header tubes 6, 7 relative to one another. This first cover plate 12 acts, in this way, as an axial fluid-tight cover element. For this purpose, it is fitted over the right-hand end (in FIG. 3) of the two header tubes 6, 7, which are located one below the other and parallel to one another, until it is in lateral contact with the flat-tube ends inserted into the header tubes 6, 7. The header tubes 6, 7 penetrate through the insertion openings 14, 15, which have the same cross-sectional contour.

In an analogous manner, the other cover plate 13 is fitted over the two header tubes 6, 7 at the opposite end until it is laterally in contact with the flat-tube ends introduced into the header tubes 6, 7, as may be seen, again, in FIG. 3. In contrast to the C-shaped insertion openings 14, 15 of the first cover plate 12, this second cover plate 13 has (as may be seen from FIG. 5) one circular insertion opening 16, 17 for each of the two adjacent header tubes 6, 7, and the diameter of these circular insertion openings 16, 17 corresponds approximately to the outer diameter of the header tubes 6, 7. Therefore, when the cover plate 13 is fitted on the header tubes 6, 7 pass through the respectively associated circular insertion openings 16, 17.

As shown in FIG. 3, a respective connecting tube 18, 19, which is preferably widened at the end, is fitted axially onto the ends of the two header tubes 6, 7 which are inserted through the insertion openings 16, 17. The ends of the connecting tubes 18, 19 then butt against the cover plate 13, which for its part butts against the flat-tube ends introduced into the header tubes 6, 7. These butt-connections are filled during the brazing process, in which the whole of the tube-block complex is sealed, fluid-tight, with brazing material. The same applies to the fluid-tight connection of the other cover plate 12 to the header tubes 6, 7, on the one hand, and to the flat-tube ends inserted in the header tubes, on the other hand. For this purpose, the cover plates 12, 13 preferably also comprise brazing alloy-clad material.

The aperture shape of the cover plate 12, shown in FIG. 4 and corresponding to the C cross-sectional contour of the header tubes 6, 7, has the result that this cover plate 12 completely closes the inner flow cross section of the header tubes 6, 7 by means of its two inner regions 12*a*, 12*b* , which are surrounded by the C-shaped insertion openings 14, 15, i.e., this cover plate acts as an axial closing element which covers, in a fluid-tight manner, the two header tubes 6, 7 on the end at the right-hand side of FIG. 3.

In contrast to this, the circular aperture openings 16, 17 of the other cover plate 13 leave the inner flow cross section of the two header tubes 6, 7 free so that, on the corresponding connection end (to the left in FIG. 3), there is an undisturbed flow connection of each of the two connecting tubes 18, 19 to the associated header tubes 6, 7. On the other hand, the parallel passageways in the two flat serpentine tubes 1, 2 are in fluid connection with the respective header tubes 6, 7. In this way, the refrigerant used can be distributed via the one connecting tube and the associated header tube into the two flat serpentine tubes 1, 2, in parallel, where it flows from the inside to the outside or from the outside to the inside in the tube block, depending on the connection direction selected. The refrigerant is subsequently collected again in the other header tube and led away via the other connecting tube.

The above explanation with particular reference to a preferred exemplary embodiment makes it clear that the heat exchanger tube block according to the invention can be manufactured with relatively little investment and/or complication. A particular advantage is gained by the fact that the header tubes have a continuous longitudinal slot, which can be easily realized from the stand-point of manufacturing technology and which, because it is not necessary to observe any tolerances in the axial direction, greatly facilitates the fitting in of the flat-tube ends. The axial covering is advantageously effected by the two cover-plate elements, which can be fitted over the header tubes after the flat-tube ends have been fitted into the header tube longitudinal slots.

It is obvious that the heat-exchanger tube block according to the invention is suitable not only for evaporators of motor vehicle air-conditioning installations but also for any other type of heat exchangers having a tube-block construction employing a plurality of header tubes with flat tubes fitted into them. In further embodiments (not shown) of the invention, a tube block can be provided with straight flat tubes, and/or more than two parallel header tubes can be provided, and in the latter instance at least one axially sealing cover-plate element (which corresponds functionally to the cover plate 12 of FIG. 4) can be applied to two (or more, if required) of these header tubes, for the purpose of axial sealing. In a further alternative embodiment, it is possible to dispense with the cover-plate element of the type in which the inner flow cross section of the header tubes is left at least partially free, as is the case with the cover plate 13 of FIG. 5. In this case, a correspondingly different, conventional connection structure is selected on the header tube connection side. It is also obvious that, depending on the number of header tubes to be accommodated, the cover-plate elements are provided with a corresponding number of insertion openings of the type closing the header-tube flow cross section or leaving it free. A further embodiment according to the invention includes a plurality of tube-block units, of the type shown in FIG. 1, sequentially arranged in a block depth direction at right angles to the plane of the drawing in FIG. 1. In this arrangement, the two header tubes can extend over the whole of the block depth and can be used jointly by the sequentially located tube block units. Elements, such as cover plate 13, can be inserted as spacers between contiguous tube-block units, for example.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A heat-exchanger tube block, comprising:

at least two header tubes, each of which has a C-shaped cross section defining an inner flow cross-section and a continuous longitudinal slot therein;

at least two flat tubes inserted into the header-tube longitudinal slots; and a first cover-plate element having a plurality of C-shaped openings therein, the first cover-plate element being applied to a first end of the at least two header tubes, such that each header tube respectively fits into one of the openings and is secured therein in a fluid-tight manner.

2. A heat exchanger tube block as claimed in claim 1, further comprising a second cover-plate element applied to a second end of the at least two header tubes, the second cover-plate element having a plurality of openings for fitting over each respective header tube, the openings leaving the inner header-tube flow cross section at least partially open.

3. A heat exchanger tube block as claimed in claim 2, further comprising a connecting tube applied onto the second ends of the at least two header tubes and abutting in each case the second cover plate.

4. A heat exchanger tube block as claimed in claim 3, wherein the first and second cover plates abut opposite edges of the at least two flat tubes.

5. A heat exchanger tube block as claimed in claim 4, wherein said at least two header tubes, said at least two flat tubes, said first and second cover plate elements and said connecting tubes are brazed at abutting locations to provide a fluid-tight seal for the heat exchanger block.

6. A heat exchanger tube block as claimed in claim 1, wherein the at least two flat tubes are bent in a serpentine configuration.

7. A heat exchanger tube block as claimed in claim 6, further comprising heat-conducting fins between continuous portions of flat tubes in the serpentine configuration.

8. A heat exchanger tube block as claimed in claim 1, wherein the at least two flat tubes are in contact with one another at a point where they are inserted into each slot.

9. A heat exchanger tube block as claimed in claim 1, wherein the at least two header tubes comprise a pair of spaced header tubes having their respective C-shaped cross-sections oriented so that the respective slots face generally away from one another, and wherein a first end of a pair of flat tubes is inserted into a first one of said slots and a second end of the same pair of flat tubes is inserted into a second one of said slots.

10. A heat exchanger tube block as claimed in claim 1, wherein the at least two header tubes extend for a length beyond the width of the at least two flat tubes, and wherein the heat exchanger block comprises at least one first tube block comprising at least two flat tubes inserted into said slots at the same point along the length of the at least two header tubes.

11. A heat exchanger tube block as claimed in claim 1, wherein the at least two header tubes comprise slotted tubes formed by bending respective flat metal sheets.

12. An automotive air-conditioning system comprising a heat exchanger having a tube block, wherein the tube block comprises the improved tube block as claimed in claim 1.

* * * * *